US006671987B1

(12) United States Patent
Fenton

(10) Patent No.: US 6,671,987 B1
(45) Date of Patent: Jan. 6, 2004

(54) LUGGAGE IDENTIFICATION TAG

(75) Inventor: Timm Fenton, Lebanon, NJ (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 09/506,666

(22) Filed: Feb. 17, 2000

(51) Int. Cl.[7] ..... G09F 3/20
(52) U.S. Cl. ..... 40/6; D20/27
(58) Field of Search ..... 40/636, 646, 661.12, 40/663, 664, 665

(56) References Cited

U.S. PATENT DOCUMENTS 2,449,727 A * 9/1948 Sloane ..... 40/649
2,655,747 A * 10/1953 Duskin ..... 40/6
4,044,545 A * 8/1977 Shimizu ..... 58/42.5
4,233,715 A * 11/1980 McDermott ..... 24/217
4,616,435 A * 10/1986 Perfert ..... 40/6
D306,613 S * 3/1990 Parker ..... D20/27

* cited by examiner

*Primary Examiner*—Cassandra H. Davis
(74) *Attorney, Agent, or Firm*—Baker Botts L.L.P.

(57) ABSTRACT

A luggage identification tag has an envelope having a front wall member and a rear wall member, the wall members being of a sheet material and being joined along opposite side edges and one end edge so as to enable the envelope to receive and hold an identification card. The front wall member has a hole through which a color card received in the envelope between the identification card and the front wall member is visible. The particular color card in the envelope is selected by a user from several color cards of different colors that are furnished with the identification tag by the supplier of the luggage. A tether joined to the envelope enables the envelope to be fastened to an item of luggage.

10 Claims, 3 Drawing Sheets

LUGGAGE IDENTIFICATION TAG

BACKGROUND OF THE INVENTION

It is not uncommon for two or more identical checked luggage items owned by different persons to arrive with their owners on a given flight, thus confronting each owner with the task of identifying his or her luggage item as it whirls around on a luggage carousel surrounded by a crowd of travel-weary, often frustrated fellow travelers. It is virtually certain, moreover, that several arriving travelers among the throng gathered around the carousel cannot distinguish their luggage items from the many look-alikes in the competitive "black sea"—black luggage is currently overwhelmingly popular.

Many suppliers of luggage use a distinctive identification tag on all luggage items in their lines. Often, the luggage itself cannot readily be distinguished from similar luggage from another supplier, it being uncommon for luggage to bear a prominent trademark or logo other than the identification tag. In the first instance, many travelers can usually identify the brand of their luggage from the identification tag. There still remains to such travelers the problem of identifying a particular luggage item from other similar items of the same brand. In many cases, the only way that a particular luggage item can be identified is by looking at a personal identification card inserted in the identification tag, which often cannot be viewed until the luggage item is so close as to make it difficult to both identify the item and retrieve it from the carousel before it moves out of reach. Moreover, the tags of some luggage suppliers have windows for personal ID cards that are covered by flaps to ensure the anonymity of the owner. In those instances, the traveler has to open the flap and view the ID card in order to identify his/her luggage item which makes it all the more difficult to identify and retrieve the item.

BRIEF SUMMARY OF THE INVENTION

An object of the present invention is to provide a luggage identification tag for common use on all luggage items of a given supplier that can be readily distinguished from other identification tags that are of the same overall construction and appearance. It is also an object to provide a luggage identification tag that is primarily distinctive based on overall appearance so as to identify a particular brand and secondarily distinctive among all other such tags by virtue of a secondary identifier. Still another object is to enable a user to select the secondary identifier.

The foregoing objects are attained, in accordance with the present invention, by a luggage identification tag that has an envelope having a front wall member and a rear wall member, the wall members being of a sheet material and being joined along opposite side edges and one end edge so as to enable the envelope to receive and hold an identification card. The front wall member has a hole through which a color card received in the envelope between the identification card and the front wall is visible. The particular color card in the envelope is selected by a user from several color cards of different colors that are furnished with the identification tag by the supplier of the luggage. A tether joined to the envelope enables the envelope to be fastened to an item of luggage.

The overall construction and appearance of the identification tag, according to the present invention, may be such as to serve as a primary identifier for all luggage items of a particular supplier, which is highly advantageous from a marketing point of view. Many owners of branded luggage can recognize their brand of luggage from the tag, even the luggage itself looks very much like luggage from other suppliers. Within a particular brand, the color card that is visible through the hole serves as a secondary identifier, which is very likely to be distinguishable by an owner from a color card of an identification tag for another luggage item of the same brand, and even the exact same model, in a particular setting. Inasmuch as each owner can select a color card from several color cards of different color that come with the tag, the odds of two travelers on a single flight having luggage items of the same brand in similar or identical models with the same color card are very small.

The hole through which the color card is visible should be large enough to be seen from several feet away, so that an owner can see the tag and color card, provided that it is in a position to be viewed, before the luggage is so close to the owner on a carousel as to make it difficult to retrieve the item. In many cases, there will, in that regard, be a fairly large number of similar luggage items of the same brand on the same flight, and the first owner to see an item of his or her brand will reposition the tag for viewing the color card. Then, it can usually be seen by persons downstream along the carousel who are looking for similar luggage items of the same brand. The ability to spot one's own luggage from a distance will go a long way toward a quick and orderly retrieval—at present, people often miss their luggage on the first go around because they cannot identify it in time to retrieve it without pushing other people downstream out of the way as they scramble to grab it.

Although the color card hole may be of any suitable shape, it is desirable that it be defined by a hole edge that is free of sharp corners. Sharp corners produce concentrated stresses and might lead to tearing of the material. Suitable shapes include a rectangle with rounded corners, a circle, an oval, a dogbone shape, or other figures of variable shape. The minimum dimension of a color card hole should be about one inch, a size that allows the color card to be clearly seen from several feet away.

Luggage identification tags are often made of natural or artificial leather or a plastic film. In order to increase the durability of the hole for the color card, a grommet can be installed in the hole. Retention of a snap-in, single piece grommet is enhanced by providing a plate portion extending from the hole that is fastened to the tether.

In a preferred embodiment, the rear wall member of the envelope has a window through which the identification card can be viewed and a flap that covers the window and that can be folded back to enable an observer to view the identification card. A releasable fastener secures the flap in covering relation to the window.

DESCRIPTION OF THE DRAWINGS

For a more complete understanding of the present invention, and the advantages thereof, reference may be made to the following written description of an exemplary embodiment, taken in conjunction with the accompanying drawings.

DESCRIPTION OF THE EMBODIMENT

Figure 1:
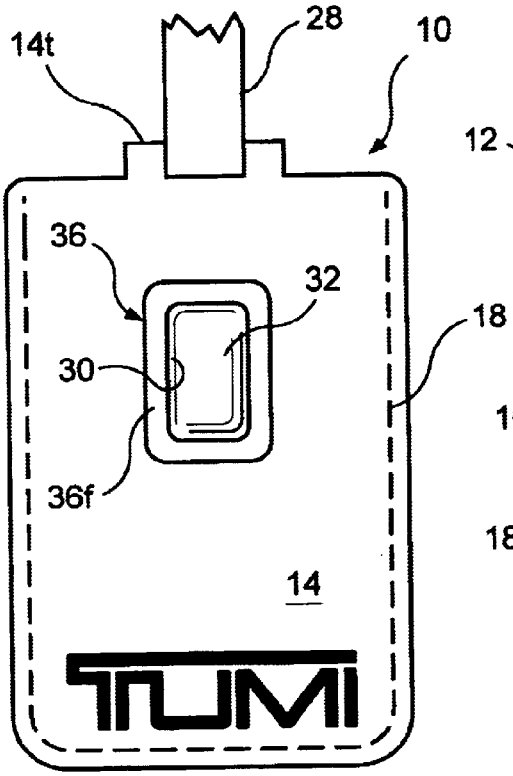
FIG. 1 is a front plan view of the embodiment.

The embodiment shown in the drawings is in most respects the same in construction and appearance as a luggage tag that has been used for several years by Tumi, Inc., the assignee of the present invention, on virtually all of its luggage products. The Tumi luggage tag is itself, by virtue of the long and consistent use throughout a broad range of luggage products, a primary identifier that many, if not most, owners of an item of Tumi® luggage will recognize from a distance as a basis for distinguishing their item of luggage from luggage items of similar appearance of other suppliers. Inasmuch as it is not unusual for two or more similar or identical pieces of Tumi® luggage to be on a luggage carousel at the same time, the distinctive Tumi luggage tag does not permit a traveler to identity his or her luggage for certain. Inasmuch as the Tumi luggage tag includes a cover flap over an ID card contained in the envelope of the tag, certain identification requires the user to release and lift the cover flap and observe the ID card. That can usually be done only by removing the item from the carousel. If the item picked by a person is not his or hers, he or she has to put the item back on the carousel and try again.

Figure 2:
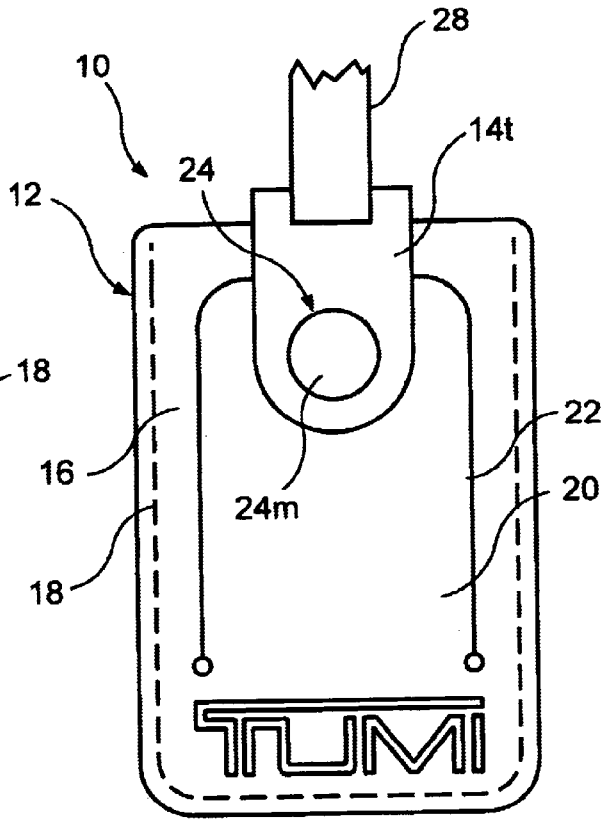
FIG. 2 if a rear plan view of the embodiment.
Figure 3:
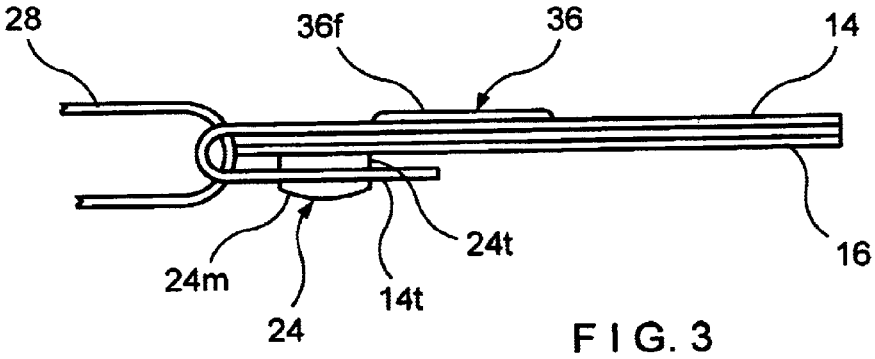
FIG. 3 is a side elevational view of the embodiment.
Figure 4:
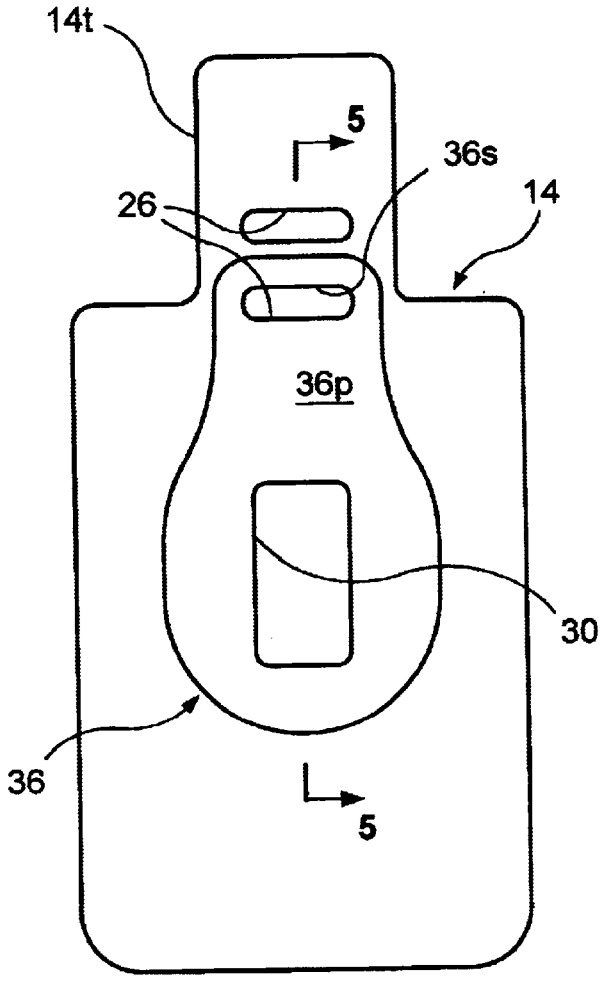
FIG. 4 is a plan view of the inside face of the front wall member of the embodiment, showing a grommet installed in the color card hole.

The luggage tag 10 has an envelope 12 assembled from a front member 14 and a rear member 16, both of natural leather, and a transparent plastic sheet (not shown) sandwiched between the leather members by stitching them together along both sides and one end (stitching 18). The rear member 16 (FIG. 2) has a flap 20 that is formed by a U-shaped cut 22. The front member 14 has a tongue 14*t* (see FIG. 4) extending from one end, which folds over in a loop with the free end overlying the flap 20. A snap fastener 24, the female element 24*t* of which is fastened to the flap 20 and the male element 24*m* of which is fastened to the tongue 14*t*, holds the flap 20 closed when the snap is done up. A pair of slots 26 accept a leather tether strap 28, which has a buckle or other suitable releasable coupling (not shown) that can be undone to enable the strap to be fed through a suitable opening on the luggage item (e.g., a handle or ring) and then refastened to secure the tag to the luggage item. The envelope accepts an ID card, which is normally concealed from view by the flap 20. By releasing the snap 24 and folding the flap open, the ID card can be viewed through the window formed by the transparent sheet.

Figure 5:
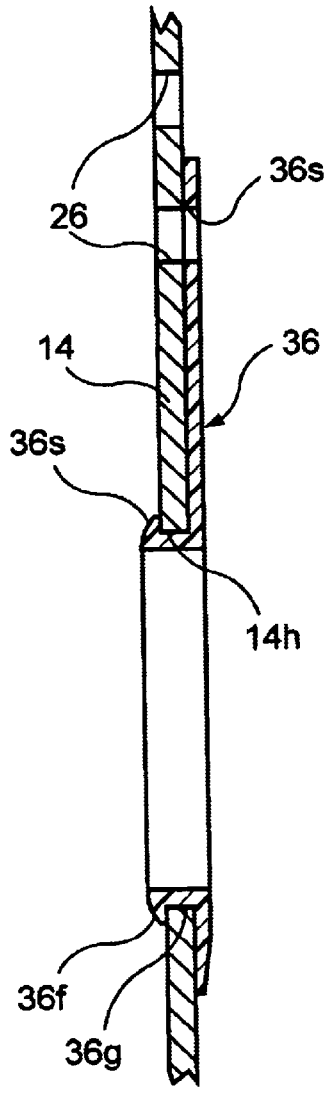
FIG. 5 is a partial side cross-sectional view of the front wall member and grommet of the embodiment, taken along the lines 5—5 of FIG. 4.
Figure 6:
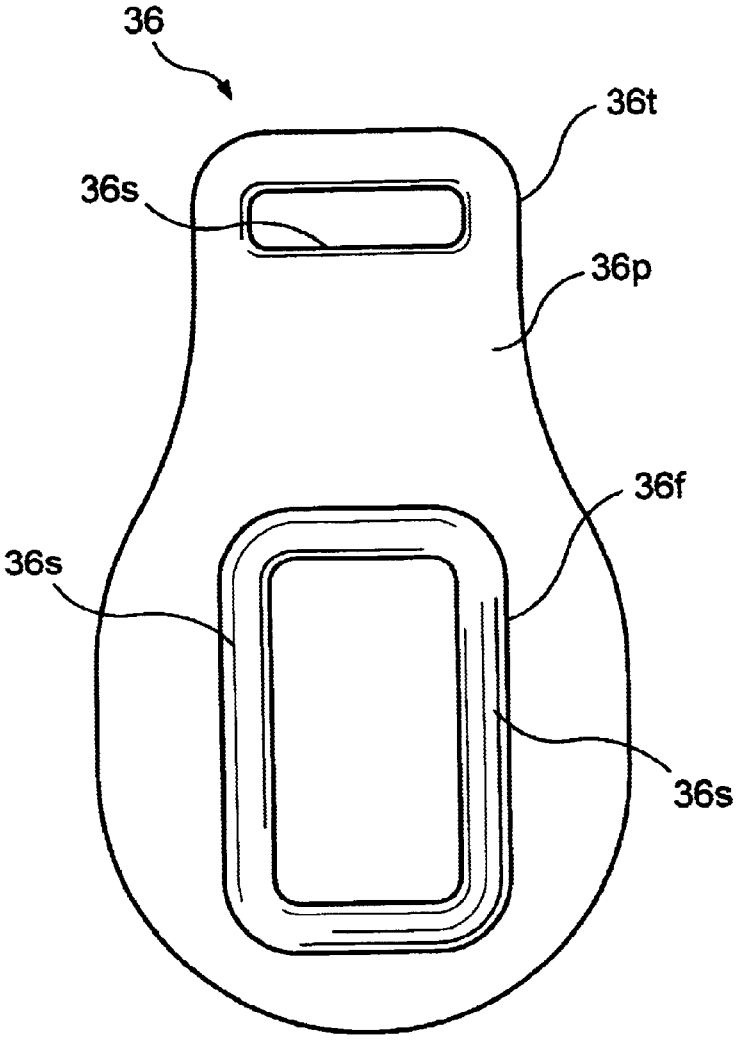
FIG. 6 is a front plan view of the grommet of the embodiment.
Figure 7:
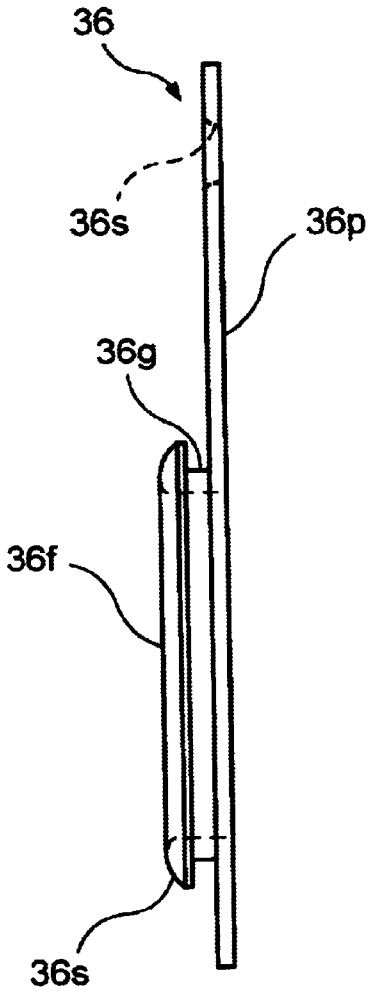
FIG. 7 is a side elevational view of the grommet of the embodiment.

The front wall member 14 of the envelope 12 has a color card window 30 through which a color card 32 received in the envelope may be viewed at all times. The color card window 30 is formed by cutting a piece out of the wall member 14 to leave a hole 14*h* (FIG. 5). Although the color card window may be a simple unfinished hole, which can be of any desired size and shape, in the front wall member, it is desirable for the sake of durability and for better appearance to frame the hole 14*h* by installing a grommet 36. In the embodiment, the grommet 36 (see FIGS. 6 and 7) is a member molded of a polymeric material and having a plate portion 36*p* and a flange portion 36*f*, the flange portion 36*f* being of "L" shape in cross section along its extent so as to form an outwardly facing groove 36*g*. The free end of the flange portion is beveled externally so as to present a surface 36*s* that slopes from the outward face of the flange portion 36*f* toward the front face of the front wall member 14 of the envelope 12. The beveled end reduces the possibility of the edge of the grommet catching on something it contacts, provides a good appearance, and facilitates installing the grommet in the hole in the wall member by pressing it into the hole. The flange portion 36*f* of the grommet 36 is retained in the hole 14*h* by capture of a band of the front wall member along the edge of the hole 14*h* in the groove 36*g* (see FIG. 5).

The plate portion 36*p* of the grommet 36 underlies a portion of the front wall member 14 surrounding the hole (see FIG. 5) and stabilizes the area of the front wall member around the grommet against bending. A tongue 36*t* of the plate portion 36*p* extends into the loop formed by the tongue portion 14*t* of the front wall member 14 and has a slot 36*s* that accepts the tethering strap 28. The coupling of the grommet 36 to the strap 28 helps prevent the grommet 36 from being dislodged from the hole 14*h*.

The color cards 32 may be simple rectangular pieces of sheet material, which may be of a plastic or paperboard, of a size slightly smaller than the envelope. The tag may be accompanied at the time of sale of a luggage item by several cards of different colors. Each card can have a different color on each face. Alternatively, each card may have two different colors on each face, part of each color on a given face of a card chosen by the user being visible through the window 30, thus presenting to the owner a two color marking in the window. It is, of course, possible, for the user to provide his own distinctive insert, such as a patterned piece of sheet material, for a custom version of color card. If the card material can accept marking, the user may mark the card in a suitable way. In any case, the probability of two luggage tags with the same color card attached to similar luggage items ending up on a luggage conveyor is very small.

In addition to providing a secondary identifier for luggage in the form of a set of color cards, any one of which can be chosen by a user, the supplier of the tag may also make the tags with grommets of various colors or with different shapes of color card windows, thereby introducing another element of distinctiveness as a secondary identifier. It is, however, preferred to maintain a uniform overall appearance for the luggage tag as a brand identifier.

What is claimed is:

1. A luggage identification tag, comprising an envelope having a front wall member and a rear wall member, the wall members being of a sheet material and being joined along opposite side edges and one end edge so as to enable the envelope to receive and hold an identification card and the front wall member having a hole;

a grommet received in the hole;

a color card of a color or colors selected by a user received in the envelope between the identification card and the front wall member so that the selected color card is visible through the hole; and a tether joined to the envelope and adapted to be fastened to an item of luggage.

2. The luggage identification tag according to claim 1, wherein the grommet includes a plate portion extending from the hole and fastened to the tether.

3. A luggage identification tag system, comprising an envelope having a front wall member and a rear wall member, the wall members being of a sheet material and being joined along opposite side edges and one end edge so as to enable the envelope to receive and hold an identification card and the front wall member having a hole;

a plurality of color cards of different colors, each shaped and sized to be received in the envelope between the identification card and the front wall member so that a color card selected by a user is visible through the hole;

each of the color cards having at least one first color on one side and at least one second color different from the first color on the other side; and a tether joined to the envelope and adapted to be fastened to an item of luggage.

4. The luggage identification tag system according to claim 3, wherein each of the color cards has two different first colors on one side and at least two second colors different from the first colors on the other side so that two colors are visible through the hole.

5. A luggage identification tag system, comprising an envelope having a front wall member and a rear wall member, the wall members being of a sheet material and being joined along opposite side edges and one end edge so as to enable the envelope to receive and hold an identification card and the front wall member having a hole;

a grommet received in the hole;

a plurality of color cards of different colors, each shaped and sized to be received in the envelope between the identification card and the front wall member so that a color card selected by a user is visible through the hole, and a tether joined to the envelope and adapted to be fastened to an item of luggage.

6. The luggage identification tag system according to claim 5, wherein the grommet includes a plate portion extending from the hole and fastened to the tether.

7. A luggage identification tag, comprising an envelope having a front wall member and a rear wall member, the wall members being of a sheet material and being joined along opposite side edges and one end edge so as to enable the envelope to receive and hold an identification card and the front wall member having a hole;

a plurality of color cards of different colors, each shaped and sized to be received in the envelope between the identification card and the front wall member so that a color card selected by a user is visible through the hole;

the rear wall member having a window through which the identification card can be viewed; and a tether joined to the envelope and adapted to be fastened to an item of luggage.

8. The luggage identification tag system according to claim 7, wherein the rear wall member has a flap that covers the window and that can be folded back to enable an observer to view the identification card.

9. A luggage identification tag, comprising an envelope having a front wall member and a rear wall member, the wall members being of a sheet material and being joined along opposite side edges and one end edge so as to enable the envelope to receive and hold an identification card and the front wall member having a hole;

the rear wall member having a window through which the identification card can be viewed and a flap that covers the window that can be folded back to enable an observer to view the identification card;

a color card of a color or colors selected by a user received in the envelope between the identification card and the front wall member so that the selected color card is visible through the hole; and a tether joined to the envelope and adapted to be fastened to an item of luggage.

10. The luggage identification tag according to claim 9, further comprising a releasable fastener securing the flap in covering relation to the window.

* * * * *